US005616022A

United States Patent [19]

Moran, IV

[11] Patent Number: 5,616,022

[45] Date of Patent: Apr. 1, 1997

[54] BARBECUE IGNITOR AND SCRAPER

[76] Inventor: Thomas J. Moran, IV, 4150 Arkwright Rd., Apt. 21, Macon, Ga. 31210

[21] Appl. No.: 367,585

[22] Filed: Jan. 3, 1995

[51] Int. Cl.[6] ..... F23Q 2/00; F23Q 2/28

[52] U.S. Cl. ..... 431/253; 431/344; 431/345; 126/25 B

[58] Field of Search ..... 30/140; 606/27, 606/28; 126/25 B, 401, 403, 404, 406, 407, 412, 413, 414, 231, 229; 431/344, 253, 345

[56] References Cited

U.S. PATENT DOCUMENTS

| | | | |
|---|---|---|---|
| 2,684,531 | 7/1954 | Smith | 126/401 |
| 2,972,035 | 2/1961 | Miller | 30/140 |
| 3,079,980 | 3/1963 | Mihm | 126/401 |
| 3,406,001 | 10/1968 | Ishibashi . | |
| 3,820,185 | 6/1974 | Phillips | 15/105 |
| 3,947,731 | 3/1976 | Vainer | 317/81 |
| 4,190,034 | 2/1980 | Wonisch | 126/25 B |
| 4,214,342 | 7/1980 | Amundsen | 15/236 R |
| 4,222,734 | 9/1980 | Nolf | 431/156 |
| 4,253,818 | 3/1981 | Ogawa et al. | 431/142 |
| 4,253,820 | 3/1981 | Jarreau | 431/344 |
| 4,292,021 | 9/1981 | Miyagawa | 431/13 |
| 4,315,731 | 2/1982 | Moore | 431/254 |
| 4,502,465 | 3/1985 | Yoshinaga | 126/409 |
| 4,516,933 | 5/1985 | Buzzi | 431/255 |
| 4,569,654 | 2/1986 | Borghesi | 431/255 |
| 4,919,111 | 4/1990 | Ohsawa | 126/25 B |
| 5,135,388 | 8/1992 | Pettit | 431/254 |
| 5,154,601 | 10/1992 | Capilla | 431/255 |
| 5,300,083 | 4/1994 | Lin et al. | 30/140 |
| 5,313,931 | 5/1994 | Coulcher, Jr. et al. | 126/406 |

*Primary Examiner*—Carl D. Price
*Attorney, Agent, or Firm*—Young & Basile, PC

[57] ABSTRACT

An ignitor and scraper device for use with barbecue grills has a hollow handle portion and an elongated tubular member extending therefrom. The handle portion houses a battery having ignitor wires that extend through the tubular member to a distal end, and a fuel cell for holding a supply of fuel. A fuel line leads from the fuel cell to the distal end of the tubular member. A valve responds to a trigger mechanism to allow fuel to flow in the fuel line. The trigger mechanism actuates the battery to generate a spark to ignite the fuel. A metal tube is secured in the tubular member and extends beyond the distal end of the tubular member, wherein the metal tube is shaped into a pair of tines. The tines are spaced to fit a barbecue rod for cleaning.

16 Claims, 3 Drawing Sheets

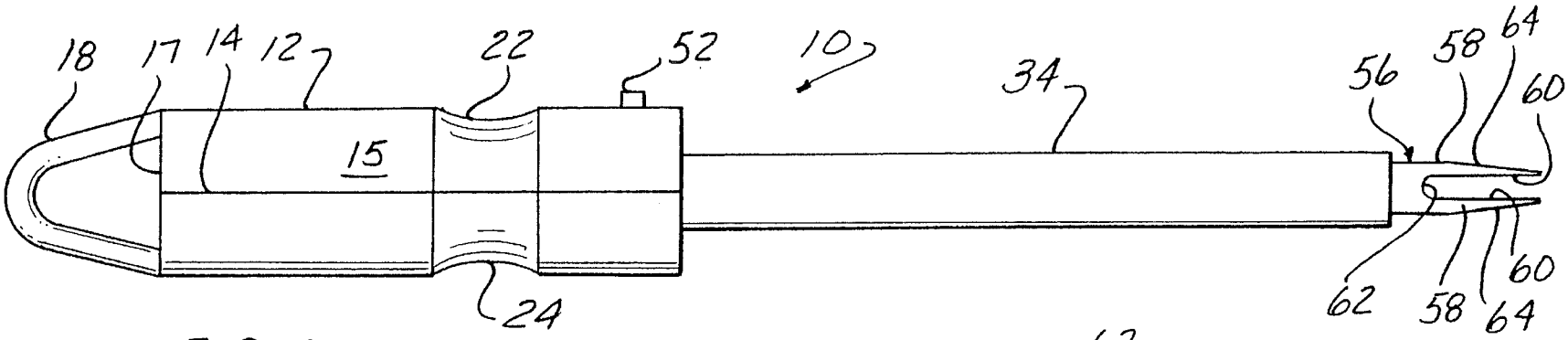
FIG-1
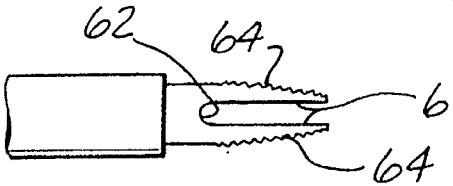
FIG-1A
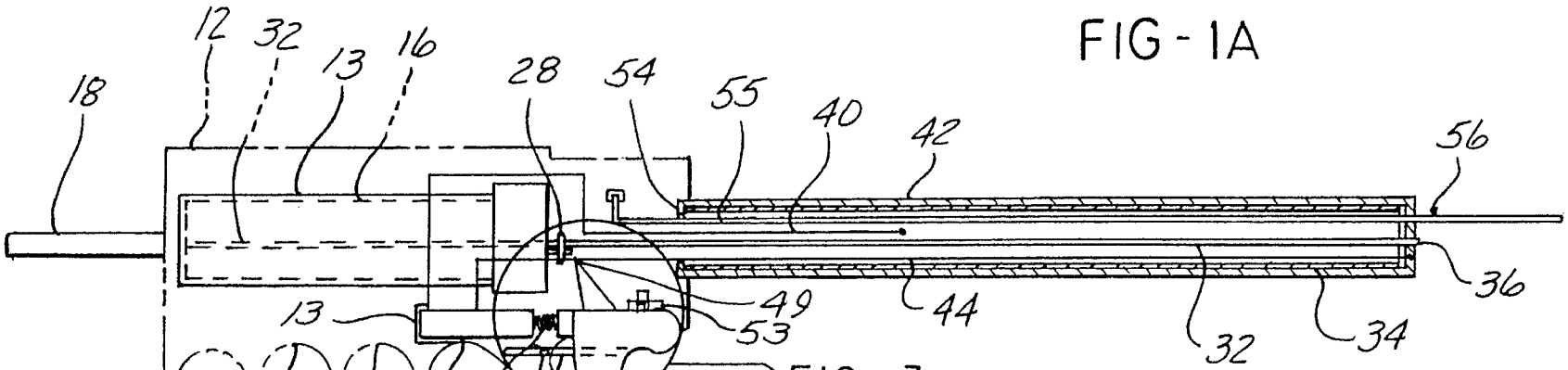
FIG-2
FIG-3

BARBECUE IGNITOR AND SCRAPER

FIELD OF THE INVENTION

This invention relates to hand-held igniting devices.

BACKGROUND OF THE INVENTION

Hand-held igniting devices or lighters have been devised with a flame bearing end located at a distance from the handle and away from the user. Such ignitors include fuel containers and a trigger operated ignitor to ignite fuel blowing from a center through valve.

Such ignition devices are widely used in areas requiring an ignitor starter such as stoves, fireplaces and barbecue grills. In the case of barbecue grills, food and other deposits can adhere to the surface of the rods forming the cooking surface of the grill. Various scraping devices are available for cleaning the grill. Such scraping devices include an elongated blade with a slot or groove at one end and sized to engage each grill rod. As a result, at least two separate tools are required to be close at hand to the barbecue grill. One tool is necessary to ignite and start the barbecue, and a second tool is later required to scrape and clean the grill.

SUMMARY OF THE INVENTION

It is an object of this invention to combine the ignitor and scraper into one device. It is also an object of this invention to include in the device a cutting and handling utensil for the food.

The ignitor has a hollow body and an elongated hollow tube member connected and extending from the hollow body at a first end and having a second end spaced from the first end for a flame. A fuel container is mounted inside the hollow body. A valve is connected to the fuel container. A trigger is mounted on the body and is operatively connected to the valve. The trigger opens and closes the valve for directing fuel from the fuel container through the valve to the end of the tubular member. An ignitor means is responsive to movement of the trigger to the open position for generating a spark to ignite the fuel.

A scraper means is mounted in the tubular end and extends outwardly from the second end of the tubular member. The scraper means include a pair of pointed tines that are spaced to fit over a grill rod. The tines are also configured to function as a cutting and spearing implement. The scraper is further configured to provide a wind shield for the flame, and a means to lift a grill screen away from the grill.

Other objects, advantages and applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein:

FIG. 1 is a top view of the combination ignitor and scraper;

FIG. 1*a* is an alternate embodiment of the scraper;

FIG. 2 is a cut-away side view of the combination ignitor and scraper showing an ignition trigger lock and a fuel cell;

DESCRIPTION OF THE PREFERRED EMBODIMENT

Figure 3:
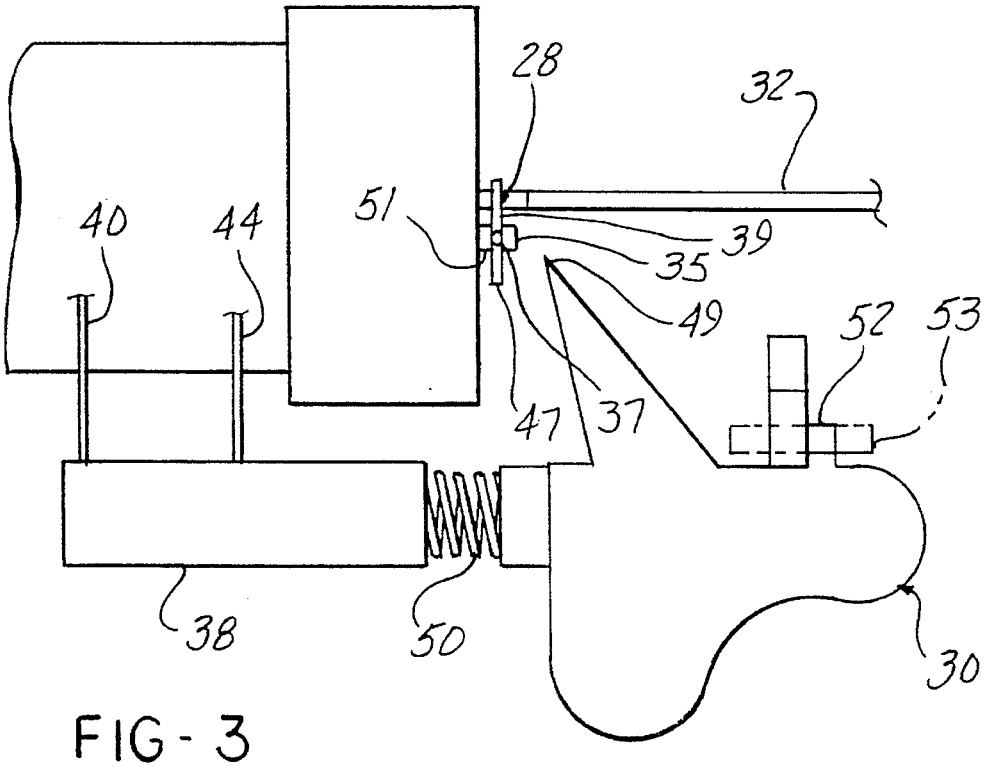
FIG. 3 is an enlarged view of the circle area of FIG. 2 showing the trigger lock in an engaged position.

The invention is a combination ignitor and scraper 10 embodied within one tool or device and having the capability of performing a number of different functions. The combination tool 10 can be used to ignite the grill, scrape the rods of the grill for cleaning, and/or fork and cut the food while cooking on the grill, to provide a wind shield for the igniting flame, and to hook the grill screen for removal of the grill screen from the grill.

The ignitor/scraper combination 10 shown in FIGS. 1 and 2 comprises a hollow body formed of two molded plastic parts that can be joined and secured by either an adhesive or a snap junction 14. The hollow body comprises a hollow handle portion 12 and an elongated tube 34 portion. The handle portion 12 has a generally hollow interior for containment of a fuel cell 16 and an ignitor source 38. The hollow interior of the handle 12 may include placement slots 13 for positioning of the fuel cell 16 and the ignitor source 38 in body 12 to prevent their movement therein. On the exterior and at one end 17 of the hollow body 12 is a plastic circular clip 18 for a hanging means when the device 10 is not in use. On the exterior and underside portion 19 of the ignitor/scraper 10 is a finger grip 20. A ridged righthand thumb indentation 22 and a ridged lefthand thumb indentation 24 are also positioned on the upper surface 15 of the tool combination 10 to accommodate both righthanded and lefthanded users. The ridged indentations 22 and 24 help to prevent the thumb from sliding on the handle 12.

Figure 5:
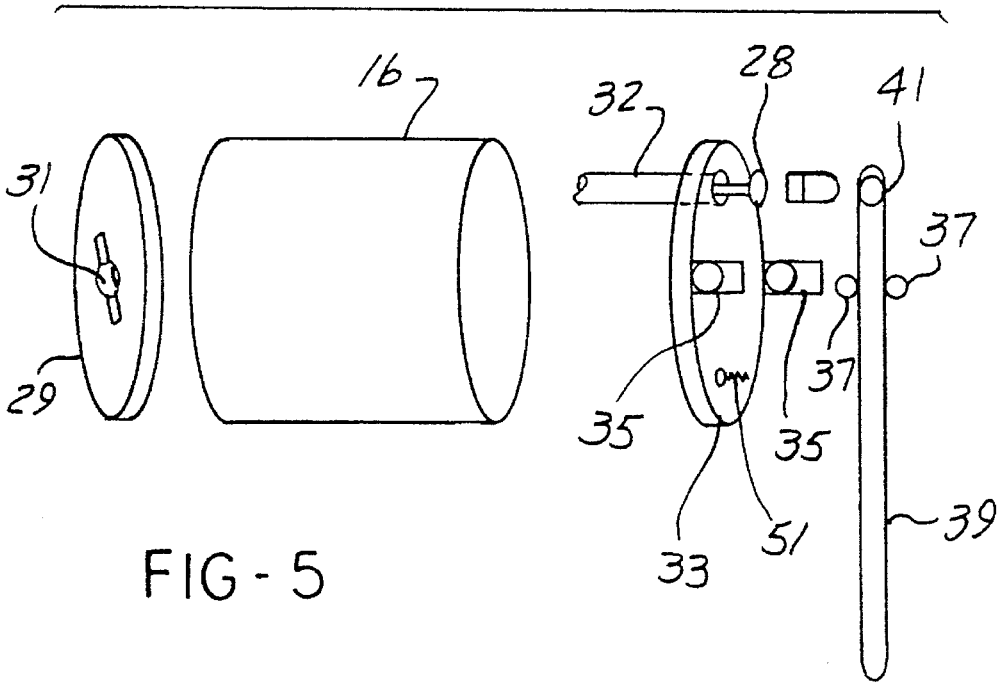
FIG. 5 is an exploded view of the fuel cell and a fuel release mechanism.

The fuel cell 16 in the interior of the hollow handle portion 12 is sized to accommodate a supply of an appropriate fuel, preferably butane. The fuel in the fuel cell 16 communicates through fuel line 32 to an outlet 36 by means of a normally closed fuel valve 28. FIG. 5 shows a side view of the fuel cell 16 comprising a bottom cap 29 having a fuel fill port 31 so that the fuel cell 16 can be filled from a standard butane refill receptacle (not shown) during the manufacture and assembly process. The bottom cap 29 is secured to the fuel cell 16 with conventional adhesives at an end distal to an outlet nozzle 36. A top cap 33 is secured to the opposite end of fuel cell 16 by adhesives. The top cap 33 has a pair of extending guides 35 laterally spaced at the perimeter of the top cap. The guides 35 are configured to receive notches 37 located on a fuel release lever 39 and ensures alignment of said lever. The function of the fuel release lever 39 will be discussed further. The fuel release lever 39 has an aperture 41 at one end for receiving a plastic fuel line 32 that extends from a bottom portion of the fuel cell proximate to the bottom cap; and continues to an outlet nozzle 36 at a distal end from the fuel cell 16. The normally closed fuel valve 28 consists of a poppet valve located at the fuel line 32 and responds to movement of the fuel release lever 39. The fuel valve 28 opens only upon activating a trigger mechanism 30. The fuel valve 28 allows fuel to flow from the fuel cell 16 to the fuel line 32 located in the elongated tube 34 extending from the hollow handle portion 12.

The elongated tubular member 34 is an extension of the hollow handle portion 12 and is constructed of the same plastic material approximately 0.065 inches thick. Tubular member 34 houses the fuel line 32 and the ignition charge wires 40, 44. A fire shield 42 covers the exterior surface of the tubular tube 34 and is held in place by tabs or notches 54 extending from the plastic elongated tube adjacent to the handle portion 12. Fire shield 42 provides a protection of the plastic tubular member 34 from the heat and flame from the grill during the igniting, cooking or scraping process. Fire shield 42 also adds strength and rigidity to the tubular member 34.

An ignition source is provided by a low voltage battery 38 having a ground wire 40 extending therefrom and attached to the tubular member 34. A positive charge wire 44 extends to the tip of the ignitor/scraper 10 at the outlet nozzle 36. The outlet nozzle 36 may be fitted with a cap 67 to protect the fuel line 32 and positive ignition wire 44. The fuel line 32 and wire 44 may also be secured by glue to cap 67 to prevent shifting within the tube 34. When the trigger mechanism 30 is engaged, it produces a connection to generate a spark. The trigger mechanism 30 comprises a trigger 46 having a finger placement 48 to manually actuate the fuel valve 28 to release the fuel from fuel cell 16. The trigger mechanism 30 is set into a guide rail 45 provided in the hollow handle portion 12. Snap-in notches 43 hold the trigger 46 in place and allow the trigger 46 lateral movement in guide rail 45. When the trigger mechanism 30 is actuated, an upper finger 49 of the trigger 46 contacts the free end 47 of the fuel release lever 39 and directs free end 47 of the lever 39 toward the fuel cell 16 so that the other end of the lever 39 lifts the poppet valve 28 to allow fuel to flow through fuel line 32. When upper finger 49 is not in contact with free end 47, a spring 51 biases free end 47 away from fuel cell 16 to automatically close poppet valve 28. This feature can be seen in FIGS. 3–5. The trigger 46 also actuates the battery 38 to discharge the spark. The trigger 46 is held to a normally off position by a spring 50 when not being manually actuated.

Figure 4:
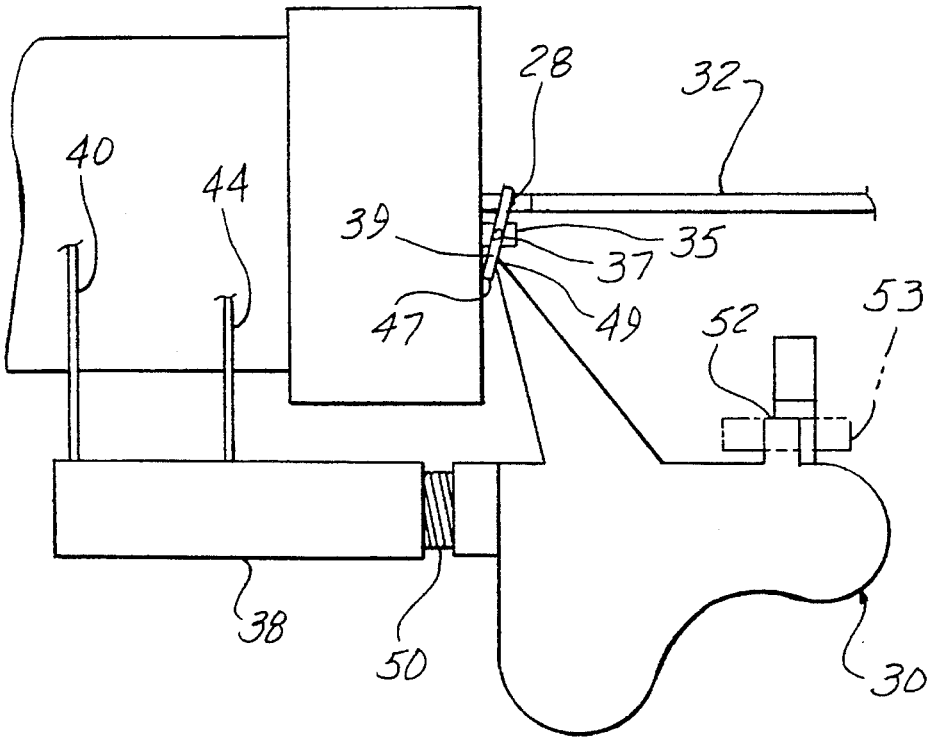
FIG. 4 is an enlarged view of the trigger lock in a disengaged position.

A trigger lock 52 is snapped in place in a second guide rail 53 of the hollow handle portion 12 to be externally exposed on the handle of the device 10. Trigger 52 is positioned to an engaged or disengaged position by sliding the lock back and forth within second guide rail 53. FIG. 3 shows the trigger lock 52 in the engaged position and FIG. 4 shows the trigger lock 52 in the disengaged position. The trigger lock 52 provides a safety feature by preventing the trigger 46 from being inadvertently actuated while using the ignitor/scraper device 10 for cleaning or cooking. When the trigger lock 52 is in the engaged position (FIG. 4), the trigger 46 may be actuated.

The scraper means 56 is made of metallic material approximately 0.015 inches thick that is injected molded into the hollow body inside the tubular member 34 and extending beyond the outlet nozzle 36. The exposed end of the scraper means 56 comprises two tines 58 spaced from each other at a distance to accommodate a rod of the grill. The inner edge 60 of each tine fits over the grill rods so that the inner groove 62 is in contact with the grill rod. The outer edges 64 of the tines 58 may be tapered and come to a point 68. The outer edges 64 may be sharpened to provide a cutting means as well as being used to pick up the food on the grill. The outer edges 64 may also be serrated edges, as shown in FIG. 1*a*, for cutting or holding the food on the grill.

Figure 6:
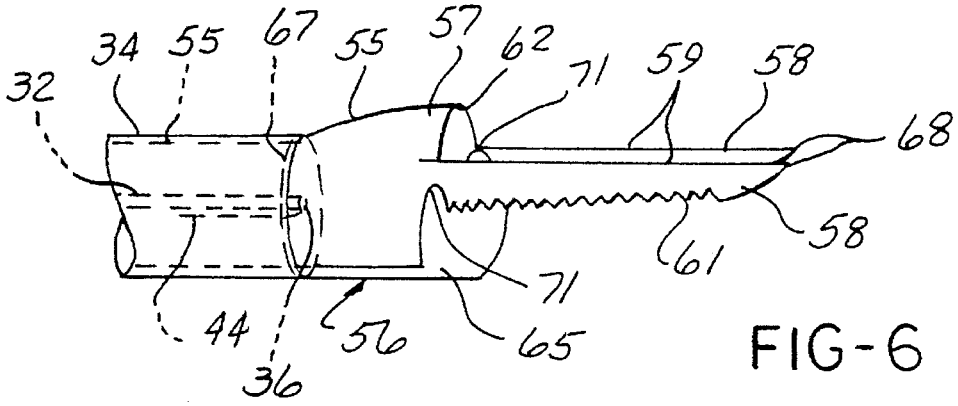
FIG. 6 is the preferred embodiment of the scraper.

A preferred embodiment for the scraper means 56 is shown in FIG. 6 where the scraper means 56 consists of a metal tube 55 mounted into tubular member 34. The metal tube 55 of the scraper means extends beyond tubular member 34. An end portion of metal tube 55 is cut in the shape of the tines 58, each having a horizontal upper edge 59 and a sharp curved or serrated lower edge 61 for cutting. The horizontal edge 59 and curved edge 61 meet at a point 68 which can be used to spear the food on the grill.

Figure 7:
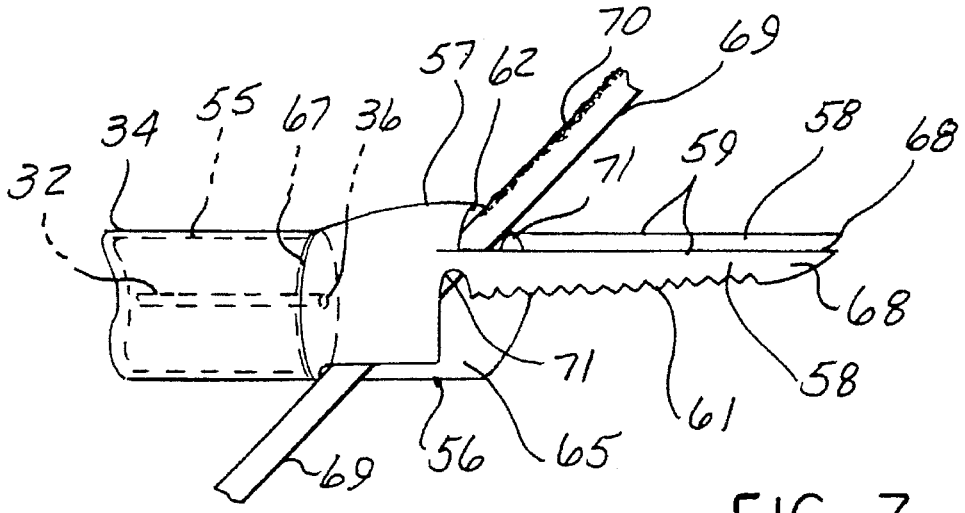
FIG. 7 shows the scraper of the preferred embodiment relative to a grill rod.

The inner groove 62 that scrapes debris 70 from a grill rod 69, as shown in FIG. 7, is formed by inserting a steel rod with a welding bead having the size of a standard grill rod into the inner diameter of the metal tube 55 of the scraper means 56. The welding bead expands metal tube 55 along an upper portion 57. The inner groove 62 of upper portion 57 is located between tines 58. As can be seen in FIG. 7, the metal tube 55 of the scraper means 56 is open along its bottom to form a channel 65. The channel 65 provides an excess passage for the grill rod 69 to inner groove 62 for scraping off accumulated grease or debris 70.

In the preferred embodiment, the fuel line 32 and ignition wires 40, 44 are located in metal tube 55 and extend to cap 67 where they are glued in place. The extension of the metal tube 55 beyond tubular member 34 offers the advantage of protecting the flame at the outside nozzle 36 from wind or other forces that may extinguish the flame.

Another advantage of the preferred embodiment is that the configuration provides a means for lifting a grill screen away from the grill. Hooks 71 are formed integrally in the exposed end of the metal tube 55 adjacent to the tines 58. The U-shaped hooks 71 grasp the grill rods and hold the grill screen until released. Hooks 71 allow the grill screen to be removed, for example, when the screen is too hot to physically touch.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. An igniting and scraping apparatus comprising:

a hollow body comprising a hollow handle portion;

an elongated hollow tubular member communicating and extending from the hollow handle portion at a first end and having a second end spaced from the first end;

a fuel container mounted in the hollow handle portion of the body for holding a supply of fuel;

a valve communicating to the fuel container;

a trigger mounted on the body and connected to the valve, said trigger movable from a first normally closed position to a second open position for selectively moving the valve to an open position thereby directing fuel from fuel container;

an elongated fuel supply line connected to the valve at one end and extending to the second end of tubular member for communicating fuel flow to said second end;

an ignitor responsive to movement of the trigger to the second position for generating a spark in the fuel flow at the second end of the fuel supply line to ignite fuel; and a scraper mounted in the tubular member, the scraper formed of a planar member having a first end extending outward from the second end of the tubular member, a slot extending from the first end of the planar member to a central edge, and two spaced tines formed on opposite sides of the slot and extending from the central edge to the first end of the planar member.

2. The igniting and scraping apparatus of claim 1 wherein the ignitor further comprises a low voltage battery and a pair of ignitor wires, said pair of wires each having an end connected to the battery.

3. The igniting and scraping apparatus of claim 2 wherein the battery is housed in the hollow body and said other end of one ignitor wire is connected to ground, and said other end of the other ignitor wire extends to the second end of the tubular member.

4. The igniting and scraping apparatus of claim 1 further comprising a trigger lock movable from an engaged position and a disengaged position, said trigger lock engageable with a trigger in the engaged position, wherein movement of the trigger is prevented when the trigger lock is in the engaged position.

5. The igniting and scraping apparatus of claim 1 wherein the tines of the scraper taper from the center edge to pointed ends.

6. The igniting and scraping apparatus of claim 1 wherein serrated edges are formed on outer portions of the tines.

7. The igniting and scraping apparatus of claim 1 wherein the planar member of the scraper is fixedly mounted to the body.

8. An igniting and scraping apparatus comprising:

a hollow body comprising a hollow handle portion;

an elongated hollow tubular member communicating and extending from the hollow handle portion at a first end and having a second end spaced from the first end;

a fuel container mounted in the hollow handle portion of the body for holding a supply of fuel;

a valve communicating to the fuel container;

a trigger mounted on the body and connected to the valve, said trigger movable from a first normally closed position to a second open position for selectively moving the valve to an open position thereby directing fuel from fuel container;

an elongated fuel supply line connected to the valve at one end and extending to the second end of tubular member for communicating fuel flow to said second end;

an ignitor responsive to movement of the trigger to the second position for generating a spark in the fuel flow at the second end of the fuel supply line to ignite fuel;

a scraper mounted in the tubular member and having a first end extending outward from second end of the tubular member; and a fire shield covering an exterior of the elongated hollow tubular member.

9. An igniting and scraping apparatus comprising:

a hollow body comprising a hollow handle portion;

an elongated hollow tubular member communicating and extending from the hollow handle portion at a first end and having a second end spaced from the first end;

a fuel container mounted in the hollow handle portion of the body for holding a supply of fuel;

a valve communicating to the fuel container;

a trigger mounted on the body and connected to the valve, said trigger movable from a first normally closed position to a second open position for selectively moving the valve to an open position thereby directing fuel from fuel container;

an elongated fuel supply line connected to the valve at one end and extending to the second end of tubular member for communicating fuel flow to said second end;

an ignitor responsive to movement of the trigger to the second position for generating a spark in the fuel flow at the second end of the fuel supply line to ignite fuel; and a scraper mounted in the tubular member and having a first end extending outward from second end of the tubular member, the scraper comprising:

a metal tube inserted into the elongated tubular member; and said metal tube having an end exposed from the tubular member wherein an end portion of said exposed end is cut to form a pair of spaced tines.

10. The igniting and scraping apparatus of claim 9 wherein an inner groove is formed on the end of the metal tube between said tines to form a scraping surface.

11. The igniting and scraping apparatus of claim 10 wherein the exposed end of the metal tube has a channel at a lower portion for accessing a grill rod to the scraping surface.

12. The igniting and scraping apparatus of claim 11 wherein the exposed end of the metal tube shields the second end of the fuel supply tube.

13. The igniting and scraping apparatus of claim 12 further comprising U-shaped hooks adjacent to the tines.

14. The igniting and scraping apparatus comprising:

a hollow body comprising a hollow handle portion;

an elongated hollow tubular member communicating and extending from the hollow handle portion at a first end and having a second end spaced from the first end;

a fuel container mounted in the hollow handle portion of the body for holding a supply of fuel;

a valve communicating to the fuel container;

a trigger mounted on the body and connected to the valve, said trigger movable from a first normally closed position to a second open position for selectively moving the valve to an open position thereby directing fuel from fuel container;

an elongated fuel supply line connected to the valve at one end and extending to the second end of tubular member for communicating fuel flow to said second end;

an ignitor responsive to movement of the trigger to the second position for generating a spark in the fuel flow at the second end of the fuel supply line to ignite fuel;

a low voltage battery and a pair of ignitor wires, said pair of wires each having an end connected to the battery;

a planar scraper member fixedly mounted in the tubular member, the planar scraper member having a first end extending outward from the second end of the tubular member, a slot extending from the first end and forming two spaced tines joined at a central edge on the planar scraper member; and a fire shield covering an exterior of the elongated hollow tubular member.

15. The igniting and scraping apparatus of claim 14 wherein the tines of the scraper taper from the center edge to pointed ends.

16. The igniting and scraping apparatus of claim 14 wherein the scraper has serrated edges on outer portions of the tines.

* * * * *